US005802795A

United States Patent [19]

Myers et al.

[11] Patent Number: 5,802,795

[45] Date of Patent: Sep. 8, 1998

[54] SELF-RETAINING PIN FOR CONCRETE WALL PANELS

[75] Inventors: Dallas E. Myers, Middletown; Norman Cottongim, Trenton, both of Ohio

[73] Assignee: Feather Lite Innovations, Inc., Springboro, Ohio

[21] Appl. No.: 970,438

[22] Filed: Nov. 14, 1997

Related U.S. Application Data

[60] Provisional application No. 60/031,382, Nov. 20, 1996.

[51] Int. Cl.[6] ..... E04G 11/08; E04G 17/06

[52] U.S. Cl. ..... 52/426; 52/428; 52/585.1; 52/699; 52/715; 52/742.15; 52/745.1; 52/747.1; 249/40; 249/45; 249/47; 249/191; 249/196; 249/219.1; 411/348

[58] Field of Search ..... 52/426, 428, 585.1, 52/699, 715, 742.15, 745.1, 747.1; 249/40, 45, 47, 191, 196, 219.1; 411/348

[56] References Cited

U.S. PATENT DOCUMENTS

| | | | |
|---|---|---|---|
| 3,052,148 | 9/1962 | Price et al. . | |
| 3,077,653 | 2/1963 | Ward | 249/196 |
| 3,173,740 | 3/1965 | Barnes . | |
| 3,200,690 | 8/1965 | Dickman . | |
| 3,211,413 | 10/1965 | Low, II . | |
| 3,447,771 | 6/1969 | Trimmer . | |
| 3,645,160 | 2/1972 | Artioli et al. . | |
| 3,734,451 | 5/1973 | Tiernay | 249/196 X |
| 4,026,605 | 5/1977 | Emmerich . | |
| 4,030,694 | 6/1977 | Schimmel . | |
| 4,194,717 | 3/1980 | Easton et al. . | |
| 4,210,305 | 7/1980 | Williams . | |
| 4,221,357 | 9/1980 | Bowden et al. | 249/219.1 X |
| 4,280,677 | 7/1981 | Shafer . | |
| 4,467,993 | 8/1984 | Markewitz et al. . | |
| 4,643,460 | 2/1987 | Lieberg . | |
| 4,759,671 | 7/1988 | Duran . | |
| 4,901,497 | 2/1990 | Lee . | |
| 4,975,009 | 12/1990 | Easton et al. . | |
| 5,058,855 | 10/1991 | Ward . | |
| 5,080,321 | 1/1992 | Carlson . | |
| 5,174,909 | 12/1992 | Ward . | |
| 5,224,806 | 7/1993 | Duran . | |
| 5,251,868 | 10/1993 | Trimmer et al. . | |
| 5,288,051 | 2/1994 | Ward . | |
| 5,409,193 | 4/1995 | Baxter | 249/196 X |
| 5,452,979 | 9/1995 | Cosenza . | |
| 5,509,635 | 4/1996 | Jaruzel . | |

*Primary Examiner*—Christopher Kent
*Attorney, Agent, or Firm*—Wood, Herron and Evans, L.L.P.

[57] ABSTRACT

A pin and wedge combination to couple adjacent panels of a concrete wall form together includes a self-retaining pin with a spring biased ball to temporarily retain the pin in the hole in the flange of the panel during assembly of a concrete wall form without adding significant weight to the associated components or the panels or requiring costly modifications to existing panels.

13 Claims, 2 Drawing Sheets

SELF-RETAINING PIN FOR CONCRETE WALL PANELS

This is a continuation-in-part of U.S. Provisional Patent Application Ser. No. 60/031,382 filed Nov. 20, 1996, which is hereby incorporated by reference.

BACKGROUND OF THE INVENTION

This invention relates to poured concrete wall forms, and more particularly, to connecting hardware for panels coupled together and used to construct the concrete wall form.

It is well known in the art to use prefabricated reusable panel units to construct a wall form for a poured concrete wall. The hardware associated with such panels connects the panels to one another to form the wall form.

Typically, each panel has a marginal frame projecting rearwardly from a back face of the panel to include a flange along the spaced side edges of the panel. The flanges are adapted to be positioned in an edge to edge relationship with the flange of an adjacent panel to construct a concrete wall form. Holes in the flanges of the adjacent panels can be aligned to receive therethrough the shank of a pin or a bolt. The bolt or pin may pass through the ends of tie-rods and are held in position commonly by wedges which are driven though a slot in the shank of the bolt or pin. As the wedges are driven in place, the abutting flanges of the adjacent panel units are drawn together. The pins and wedges constitute a simple mechanism for effectively coupling the panels together. Furthermore, the pins and wedges can be removed from the panels during the dismantling of the wall form by simply knocking out the wedges from the slots and sliding the pins from their holes to release the adjacent panel units.

In the construction of a concrete wall form, a large quantity of hardware is necessary to connect the adjacent panels together and it is customary for the workers performing the construction operation to carry a large bucket of the pins and wedges with them to join the adjacent panels together. During such operations, the loss of the attachment hardware, specifically the pins and wedges is appreciable especially in inclement weather as it is difficult for a worker wearing gloves to handle the pins and wedges. Furthermore, the wall forms are commonly constructed in excavated areas such as ditches and trenches when preparing the wall form for a poured concrete wall in a residential basement or below ground floor of a commercial building. As such, the work space for constructing the wall form and for the workers to maneuver and manipulate the associated hardware is extremely tight and limited. Therefore, the installation of the pins and wedges is even more difficult and the retrieval of any lost hardware is very problematic. The cost of labor and materials, therefore, has increased accordingly.

One prior art solution to some of these problems has been to permanently connect the attachment hardware to the panels. With such devices, each panel includes numerous such mechanisms. Problems frequently arise because the hardware permanently affixed to the panels breaks or requires repair thereby taking that particular panel out of service until it is repaired. Furthermore, due to the addition of the attachment hardware, each panel is significantly heavier placing a much greater burden on the workers for transporting, installing and manipulating the panels in constructing and disassembling the wall form. Moreover, a particular contractor may have an inventory of panels which are not compatible with the panels having permanently affixed hardware thereby requiring the contractor to entirely discard the current supply of the panels and associated hardware in favor of the panels having an attachment hardware design. Additionally, the cost for each panel is significantly increased due to the addition of the often complicated permanently attached hardware.

Therefore, there exists a need in the industry for an attachment mechanism for coupling adjacent panels and constructing a poured concrete wall form which is easily and conveniently installed and disassembled by the workers in the field to avoid the loss of such hardware without increasing the weight or cost of the required components.

SUMMARY OF THE INVENTION

These and other objectives of the invention have been attained by an improved pin and wedge assembly for coupling adjacent panels together to form a concrete wall form. The pin and wedge combination according to a presently preferred embodiment of this invention includes a generally planar wedge as is well known in the art having a tapered configuration such that a broad end of the wedge tapers to a more narrow end of the wedge. The pin to be used in combination with the wedge, has an enlarged head and an elongated generally cylindrical shaped shank extending from the head and a tapered end opposite the head. A generally rectangular through slot is included in the shank proximate the tapered end and extends perpendicularly to a longitudinal axis of the pin.

Advantageously, the pin according to this invention includes a cylindrical shaped cavity in the shank in which the cavity is aligned perpendicularly to the longitudinal axis of the pin proximate the head. The cavity is open at a top end thereof and terminates in a lip surrounding the cavity on the surface of the shank. A compression spring is seated on the bottom on the cavity and a ball is captured in the cavity by the lip and is biased by the compression spring so that a portion of the ball projects from the shank of the pin.

In constructing the wall form using the pin and wedge combination according to this invention, adjacent panels are positioned with the associated holes in adjacent flanges being aligned so that the pin can be inserted therethrough until the head contacts one of the flanges. Advantageously, the pin is retained in the hole in the flange prior to the final assembly of the panels and the wedge being inserted through the slot by the ball being partially compressed by the socket or side wall of the hole in the flange. The ball is biased into contact with the side wall of the hole in the flange while a tie-rod is slipped onto the pin and until the adjacent panel is joined by inserting the narrow end of the wedge into the slot to secure the pin in the holes and releasably couple the panels together.

As a result, the pin according to this invention provides a simple and cost effective attachment mechanism to overcome the problems of previously known pins. Specifically, the pin is self retained in the hole after being inserted therein by the worker so that the tie-rod can be easily placed over the pin without dislodging the pin from the hole. Furthermore, the flanges of the adjacent panels can be aligned prior to the wedge securing the pin to the assembly and the pin is retained in position in the holes in the flanges by the ball being biased into contact by the spring with the side wall of the hole. As a result, the pin and wedge combination of this invention can be used with currently existing panel designs utilizing previous pin and wedge combinations without replacing an entire inventory of panels. Furthermore, the cost of the pin according to this invention is very economical especially in comparison with attachment mechanisms which are fixed to the panels. Moreover, the pin and wedge of this invention is substantially the same weight as a standard pin and wedge thereby not increasing the burden on the workers when handling the attachment hardware and the panels to construct and disassemble the poured concrete wall form.

BRIEF DESCRIPTION OF THE DRAWINGS

The objectives and features of the invention will become more readily apparent from the following detailed description taken in conjunction with the accompanying drawings in which.

DETAILED DESCRIPTION OF THE INVENTION

Figure 1:
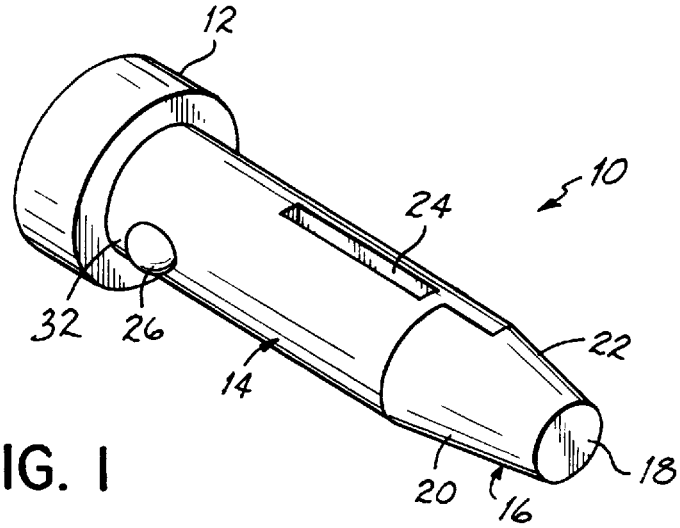
FIG. 1 is a perspective view of a presently preferred embodiment of a pin according to this invention.

Referring to FIG. 1, a presently preferred embodiment of a pin 10 according to this invention is shown. The pin 10 includes an enlarged disk shaped head 12 and an elongated generally cylindrical shaped shank 14 extending from the head 12. A tapered end 16 opposite the head 12 terminates in a blunt tip 18. The tapered end 16 includes a first slope extending around a first portion 20 of the circumference of the shank 14 , preferably 180° and a second portion 22 having a greater slope extending around a remainder, preferably 180° of the circumference of the shank 14 for purposes of which will be described herein below. The pin 10 also includes a generally rectangular through slot 24 in the shank 14 proximate the tapered end 16 and extending perpendicularly to a longitudinal axis of the pin 10. A portion of a ball 26 projects from the surface of the shank 14 proximate the head 12. The ball 26 is positioned proximately 90° from the axis of the slot 24 in a presently preferred embodiment.

Figure 3:
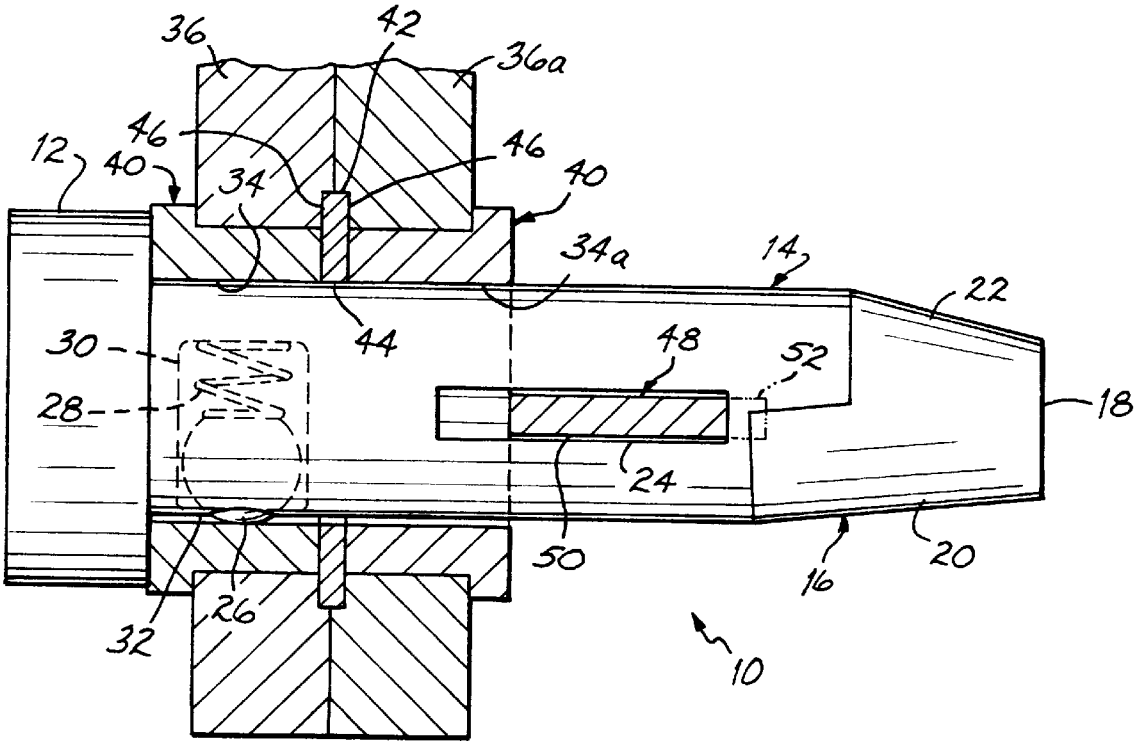
FIG. 3 is a cross-sectional enlarged view of the pin and wedge combination according to this invention coupling the adjacent panels together.

As shown in FIGS. 1 and 3, the ball 26 is seated on a compression spring 28 so that it is biased outwardly from the longitudinal axis of the pin 10 so that the portion of the ball 26 projects from the surface of the shank 14. The spring 28 is seated on the bottom surface of a generally cylindrical cavity 30. The cavity 30 has an open end and the ball 26 is retained in the cavity 30 by a lip 32 surrounding the cavity 30 on the surface of the shank 14. Preferably, the ball, spring and pin are fabricated from steel as is well known by those of ordinary skill in the art.

Figure 2:
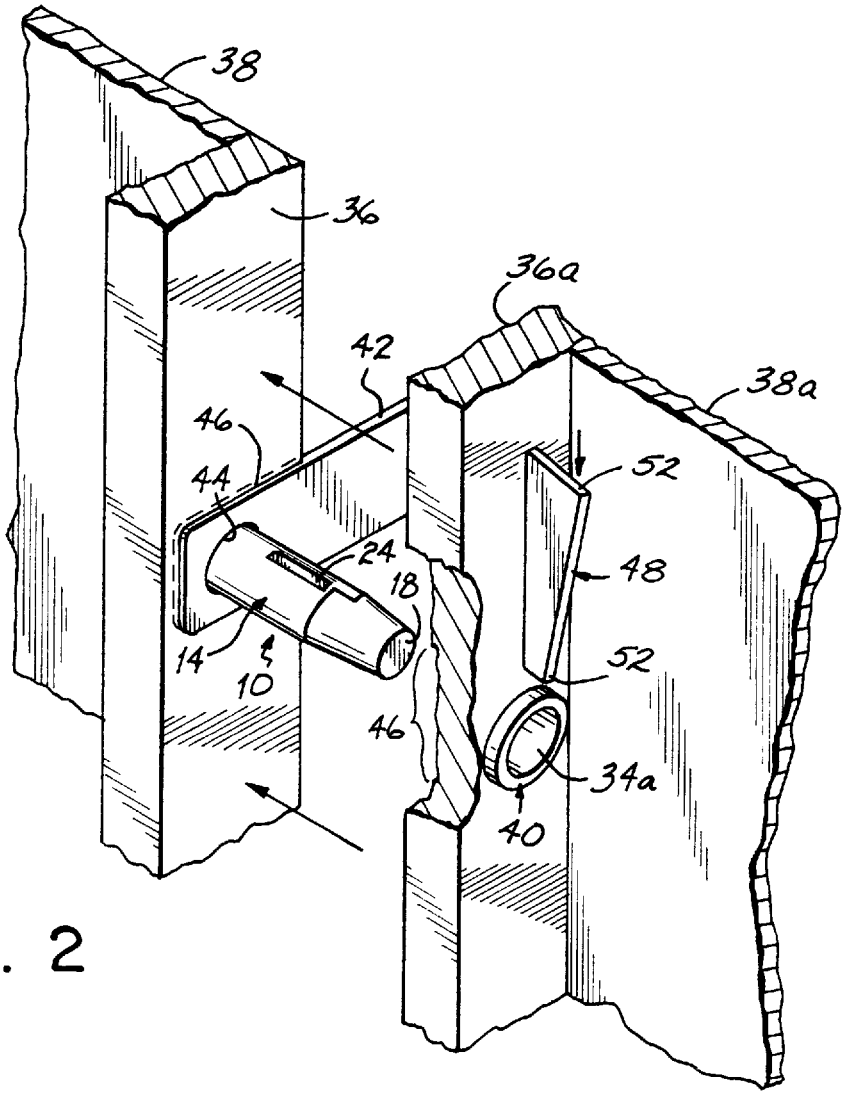
FIG. 2 is a perspective view of the pin of FIG. 1 inserted through a hole in a flange of a first panel with a tie-rod held on the shank of the pin which is aligned with the hole in the flange of the second panel to be held there in place by the wedge.

Referring to FIGS. 2 and 3, the shank 14 of the pin 10 is sized for insertion through a hole 34 in a flange 36 of a panel 38 used for constructing a concrete wall form. The hole 34 in the flange 36 is aligned with a similarly configured hole 34*a* in the flange 36*a* of an adjacent panel 38*a*. The flange 36, 36*a* may include a bushing 40 seated in the hole 34, 34*a* and the diameter of the opening in the bushing 40 is less than the diameter of the disk shaped head 12 on the pin 10 thereby preventing the head 12 from passing through the holes 34, 34*a* in the flanges 36, 36*a*.

As is well known in the art, a tie-rod 42 having hole 44 proximate an end thereof extends between the panels 38, 38*a* of the concrete wall form to maintain the spacing between opposed panels (not shown) forming a cooperating wall form (not shown). The flanges 36, 36*a* may include a notch or cut-out 46 sized and configured to accommodate the tie-rod 42 seated in the cut-out 46 so that the flanges 36, 36*a* of the adjacent panels 38, 38*a* can be juxtaposed in face to face abutting relationship.

A wedge 48 according to a presently preferred embodiment of this invention is well known in the art and includes a generally planar piece of steel or other appropriate metal which is dimensioned to fit within the slot 24 in the pin 10. The wedge 48 has a tapered configuration so that a narrow end 50 of the wedge 48 passes into and through the slot 24 and a broad end 52 of the wedge 48 is wider than the slot 24 and is thereby prevented from passing through the slot 24. One presently preferred embodiment of a wedge 48 which could be used in this invention is disclosed in U.S. Provisional Patent Application Ser. No. 60/035,666 filed Jan. 21, 1997, which is hereby incorporated by reference. in assembling a concrete wall form according to this invention, the adjacent panels 38, 38*a* are positioned with the respective holes 34, 34*a* in the flanges 36, 36*a* being generally aligned and the flanges 36, 36*a* initially being spaced. The pin 10 is inserted into the hole 34 in the flange 36 by the worker so that the head 12 contacts the bushing 40 and is prevented from passing through the hole 34 as shown in FIG. 2. Advantageously, insertion of the shank 14 into the hole 34 forces the ball 26 to retract into the cavity 30 thereby compressing the spring 28. The ball 26 is maintained in contact with the side wall of the hole 34 or the bushing 40 as shown in FIG. 3 so that the pin 10 is temporarily retained in position in the hole 34 in the flange 36. As a result, the pin 10 will not become easily dislodged or fall from the hole 34 and become lost at the work site and require retrieval. Furthermore, the pin 10 is retained in the flange 36 while the tie-rod 42 is slipped onto the shank 14 of the pin 10 as shown in FIG. 2. The tie-rod 42 is seated within the notch 46 in the flange 36. Advantageously, the pin 10 is temporarily retained on the flange 36 by the spring biased ball 26 so that inadvertent jostling or contact by the tie-rod 42 on the pin 10 will not dislodge the pin 10.

After the pin 10 is inserted in the flange 36 and retained there by the spring biased ball 26 and the tie-rod 42 is fitted over the shank 14 of the pin 10, the adjacent panel 38*a* is moved into abutting relationship with the panel 38 so that the shank 14 of the pin 10 projects through the aligned hole 34*a*. Once again, the pin 10 is retained in position by the spring biased ball 26. Lastly, the narrow end 50 of the wedge 48 is inserted into the slot 24 and hammered or forced into place thereby releasably coupling and binding the adjacent panels 38, 38*a* and tie-rod 42 together and forming the concrete wall form. Disassembly of the wall form is easily accomplished by dislodging the wedge 48 from a slot 24 and pushing the pin 10 out of the holes 34, 34*a* thereby releasing the spring biased ball 26 to its normal position as shown in FIG. 1.

The dual taper configuration on the tapered end 16 of the pin 10 assists in the easy removal of the pin 10 from the holes 34, 34*a*. The forces exerted on the panels 38, 38*a* by the poured concrete often make it difficult to extract the pin 10 from the holes 34, 34*a*. Due to the greater slope of the second portion 22, the binding force between the flanges 36, 36*a* and the pin 10 is more quickly relieved as the pin 10 is withdrawn. Preferably, the second portion 22 having a greater slope is oriented 90° to the axis of the slot 24 and confronting the panel portion of the panel 38 as shown in FIG. 2.

From the above disclosure of the general principles of the present invention and the preceding detailed description of a preferred embodiment, those skilled in the art will readily comprehend the various modifications to which this invention is susceptible. Therefore, we desire to be limited only by the scope of the following claims and equivalents thereof.

We claim:

1. A combination comprising:

a pair of panels for use in constructing a poured concrete structure, each of the panels being similarly configured and having a flange extending from a face of the panel, each flange having at least one aperture formed therethrough;

a pin having an enlarged head and an elongated shank extending between the head and an end of the pin, the shank having a through slot spaced from the head and a retaining member being biased to project from the shank and being positioned intermediate the head and the slot; and a wedge having a first end which is larger than a second end thereof, the second end being sized to pass through the slot and the first end being sized not to pass through the slot;

wherein the end of the pin is inserted into and through the aperture in the flange on one of the panels and the head preventing the pin from passing entirely through the aperture, the retaining member being depressed and biased into contact with a sidewall of the aperture of the one panel to retain the pin in the aperture of the one panel while the aperture of the other panel is aligned therewith and the flanges of the panels juxtaposed to one another and the second end of the wedge inserted into and through the slot to releasably couple the panels together.

2. The combination of claim 1 wherein the retaining member is a ball which is biased to partially project from the shank of the pin by a spring seated within a cavity in the pin.

3. The combination of claim 1 further comprising:

a tie-rod to be positioned between the flanges of the concrete wall form panels, the tie-rod having a hole through which the shank of the pin is inserted, the tie-rod for being positioned between the retaining member and the slot.

4. The combination of claim 1 wherein the retaining member is oriented approximately 90° with respect to a longitudinal axis of the slot.

5. A combination comprising:

a pair of concrete wall form panels for use in constructing a poured concrete wall, each of the panels being similarly configured and having a flange extending from a face of the panel, each flange having at least one aperture formed therethrough;

a pin having an enlarged head and an elongated shank extending between the head and an end of the pin, the shank having a through slot spaced from the head and a ball being biased by a spring in a cavity in the shank to project from the shank and being positioned intermediate the head and the slot, the ball being oriented approximately 90° with respect to a longitudinal axis of the slot;

a wedge having a first end which is larger than a second end thereof, the second end being sized to pass through the slot and the first end being sized not to pass through the slot; and a tie-rod to be positioned between the flanges of the concrete wall form panels, the tie-rod having a hole through which the shank of the pin is inserted, the tie-rod for being positioned between the ball and the slot;

wherein the end of the pin is inserted into and through the aperture in the flange on one of the panels and the head preventing the pin from passing entirely through the aperture, the ball being depressed and biased into contact with a sidewall of the aperture of the one panel to retain the pin in the aperture of the one panel while the aperture of the other panel is aligned therewith and the flanges of the panels juxtaposed to one another and the second end of the wedge inserted into and through the slot to releasably couple the panels together.

6. A pin and wedge combination for connecting a first concrete wall form panel to a second concrete wall form panel wherein the first panel has a first flange extending outwardly therefrom and a first aperture formed therethrough, the second panel has a second flange extending outwardly therefrom and a second aperture formed therethrough which is aligned with the first aperture, the combination comprising:

a pin having an enlarged head and an elongated generally cylindrical shaped shank extending from the head and a tapered end opposite the head, a through slot in the shank proximate the tapered end and extending perpendicularly to a longitudinal axis of the pin, a cylindrical shaped cavity in the shank aligned perpendicularly to the longitudinal axis of the pin and proximate the head, the cavity being open at a top end thereof and terminating in a lip surrounding the cavity on the surface of the shank, a compression spring in the cavity, and a ball captured in the cavity by the lip and being biased by the spring so that a portion of the ball projects from the shank of the pin; and a planar wedge dimensioned to fit within the slot, the wedge having a tapered configuration so that a narrow end of the wedge passes into and through the slot and a broad end of the wedge does not pass through the slot;

wherein when the first and second panels are positioned with the first and second apertures aligned the pin can be inserted into the apertures and the ball is depressed into the cavity and is biased into contact with a sidewall of one of the apertures to retain the pin in the apertures during assembly of the panels and until the narrow end of the wedge is inserted into the slot to secure the pin in the apertures and releasably couple the first and second panels together.

7. The combination of claim 6 wherein the tapered end of the pin has a first slope extending around a portion of a circumference of the shank and a second greater slope extending around a remainder of the circumference of the shank to facilitate easy removal of the pin from the apertures after the wedge is withdrawn from the slot.

8. The combination of claim 6 wherein the ball and cavity are oriented about 90° with respect to a longitudinal axis of the slot.

9. A system for releasably coupling a first concrete wall form panel to a second concrete wall form panel wherein the first panel has a first flange extending outwardly therefrom and a first aperture formed therethrough, the second panel has a second flange extending outwardly therefrom and a second aperture formed therethrough which is aligned with the first aperture, the system comprising:

a pin having an enlarged head and an elongated shank extending between the head and an end of the pin, the shank having a through slot spaced from the head and a retaining member being biased to project from the shank and being positioned intermediate the head and the slot; and a wedge having a first end which is larger than a second end thereof, the second end being sized to pass through the slot and the first end being sized not to pass through the slot;

wherein the end of the pin is inserted into and through the first aperture in the first flange and the head preventing the pin from passing entirely through the first aperture, the retaining member being depressed and biased into contact with a sidewall of the first aperture to retain the pin in the first aperture while the second aperture of the second panel is aligned therewith and the first and second flanges being juxtaposed to one another and the second end of the wedge inserted into and through the slot to releasably couple the panels together.

10. The system of claim 9 wherein the retaining member is a ball which is biased to partially project from the shank of the pin by a spring seated within a cavity in the pin.

11. The system of claim 9 further comprising:

a tie-rod to be positioned between the flanges of the concrete wall form panels, the tie-rod having a hole through which the shank of the pin is inserted, the tie-rod for being positioned between the retaining member and the slot.

12. The system of claim 9 wherein the retaining member is oriented approximately 90° with respect to a longitudinal axis of the slot.

13. A method for assembling a concrete form for constructing a poured concrete structure, the method comprising the steps of:

positioning a first and a second panel relative to one another with a first flange on the first panel confronting a second flange on the second panel;

inserting an end of a pin through a first hole in the first flange;

retaining the pin in the first hole by depressing a retaining member against a sidewall of the first hole, the retaining member being biased to project from a shank of the pin;

aligning a second hole in the second flange with the pin;

inserting the end of the pin and a slot in the shank of the pin through the second hole; and inserting a first end of a wedge through the slot until the first and second flanges are juxtaposed to one another thereby releasably coupling the panels together.

* * * * *